US010101076B2

(12) United States Patent
Salomon et al.

(10) Patent No.: US 10,101,076 B2
(45) Date of Patent: Oct. 16, 2018

(54) HOUSEHOLD APPLIANCE COMPONENT HAVING A COEXTRUDED DECORATIVE PART

(71) Applicant: BSH HAUSGERÄTE GMBH, München (DE)

(72) Inventors: Frank Salomon, Heidenheim (DE); Andrea Fink, Gerstetten (DE); Denis Lux, Heidenheim (DE); Elena Claaß, Geislingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/198,165

(22) Filed: Jun. 30, 2016

(65) Prior Publication Data

US 2017/0003068 A1 Jan. 5, 2017

(30) Foreign Application Priority Data

Jul. 1, 2015 (DE) ..... 10 2015 212 350

(51) Int. Cl.

| | |
|---|---|
| ***F25D 23/02*** | (2006.01) |
| ***F25D 23/04*** | (2006.01) |
| ***F25D 25/02*** | (2006.01) |
| ***F25D 11/00*** | (2006.01) |

(52) U.S. Cl.

CPC ..... *F25D 23/028* (2013.01); *F25D 11/00* (2013.01); *F25D 23/04* (2013.01); *F25D 2400/18* (2013.01)

(58) Field of Classification Search

CPC ..... F25D 25/02; F25D 23/04; F25D 23/028; F25D 2400/18

See application file for complete search history.

(56) References Cited

U.S. PATENT DOCUMENTS

| | | | | | |
|---|---|---|---|---|---|
| 1,967,666 | A * | 7/1934 | Fisher | A47B 13/086 | 108/27 |
| 2,186,683 | A * | 1/1940 | Raymond | A47B 95/02 | 16/444 |
| 2,288,563 | A * | 6/1942 | Fall | A47B 13/08 | 108/27 |
| 2,568,153 | A * | 9/1951 | Hickman | F24C 15/16 | 211/153 |
| 3,181,176 | A * | 5/1965 | Nagy | A47K 17/00 | 108/27 |
| 3,238,741 | A * | 3/1966 | Johnson | A44C 9/02 | 63/15.6 |
| 3,313,065 | A * | 4/1967 | Sandin | E06B 3/7001 | 49/460 |
| 3,709,576 | A * | 1/1973 | Lemoine | F25D 23/04 | 211/90.03 |

(Continued)

FOREIGN PATENT DOCUMENTS

| | | |
|---|---|---|
| DE | 10 2004 012 497 A1 | 10/2005 |
| DE | 203 21 662 U1 | 10/2008 |

(Continued)

*Primary Examiner* — Kimberley S Wright

(74) *Attorney, Agent, or Firm* — Nixon & Vanderhye P.C.

(57) ABSTRACT

The invention relates to a household appliance component having a decorative part which is arranged on a base part of the household appliance component as a component bent at least once and not extending in a plane, wherein the decorative part is embodied as a coextruded part made of metal and plastic.

21 Claims, 4 Drawing Sheets

(56) References Cited

U.S. PATENT DOCUMENTS

| | | | | |
|---|---|---|---|---|
| 3,744,869 | A * | 7/1973 | Anderson | A47B 88/427 312/334.18 |
| 5,269,602 | A | 12/1993 | Kuwahara | |
| 6,308,472 | B1 * | 10/2001 | Coulton | E04D 13/176 428/906 |
| 6,908,163 | B1 * | 6/2005 | Hebeler | F25D 23/04 312/321.5 |
| 2003/0020385 | A1 * | 1/2003 | Leimkuehler | F25D 23/04 312/405.1 |
| 2006/0102572 | A1 | 5/2006 | Robertson | |
| 2009/0039749 | A1 * | 2/2009 | Gerstner | F25D 23/04 312/404 |
| 2010/0052483 | A1 * | 3/2010 | Huang | G06F 1/181 312/223.2 |

FOREIGN PATENT DOCUMENTS

| | | | |
|---|---|---|---|
| DE | 10 2009 028 784 | A1 | 2/2011 |
| DE | 10 2009 046 613 | A1 | 5/2011 |
| DE | 10 2012 209 877 | A1 | 12/2013 |
| DE | 10 2012 223 118 | A1 | 6/2014 |
| JP | 59-27816 | Y2 | 8/1984 |
| JP | 2-103382 | | 4/1990 |

* cited by examiner

HOUSEHOLD APPLIANCE COMPONENT HAVING A COEXTRUDED DECORATIVE PART

This application claims priority to DE 10 2015 212 350.2 filed 1 Jul. 2015, the entire content of which is hereby incorporated by reference.

The invention relates to a household appliance component having a decorative part which is arranged on a base part of the household appliance component as a component bent at least once and not extending in a plane. The invention further also relates to a household appliance having such a household appliance component.

A household appliance component of this type is known as a door rack from unexamined German application DE 10 2012 221 800 A1. The decorative part there is shown as a metal profile part which is an extrusion component.

Especially with decorative parts which have a metallic visual effect and do not extend in a straight line and therefore not in a plane either, the problem, especially at the bends, is to keep such pristine metal parts free of kinks and in the particular elastic state and additionally also to achieve a reliable attachment without undesired mechanical stresses.

It is the object of the present invention to create a household appliance component in which the decorative part is improved.

This object is achieved by a household appliance component and a household appliance having such a household appliance component according to the independent claims.

An inventive household appliance component comprises a decorative part which is arranged on a base part of the household appliance component as a component bent at least once and not extending in a plane. The decorative part is a component separate from the base part and is mechanically attached thereto. An essential idea of the invention is that the decorative part is embodied as a coextruded part made of metal and plastic. Such an integrally embodied decorative part made of two different materials as a coextrusion part therefore in particular enables the design of the decorative part to be improved, without undesired mechanical stresses occurring during the attachment and especially without such stresses or undesired kinks occurring at a bend. This in particular enables the decorative part to be bent in a very individual manner, since the metal/plastic compound can also be bent plastically, which is not possible with plastic alone.

Preferably it is provided that the metal is embodied on a visible face of the decorative part. This means the entire decorative part acts as a complete metal part, but as a coextruded part nevertheless guarantees a more light-weight design and a more individual form of elasticity.

In particular it is provided that the metal is aluminum. Such a material specification reduces the weight of the decorative part further and on the other hand provides multiple opportunities for forming the metal effect of the decorative part.

Preferably it is provided that the decorative part is embodied as a strip. This means a very sophisticated decorative trim can be provided. The aforementioned advantages are particularly promoted especially in the case of a strip of this type and a coextruded part can be regarded as particularly advantageous. Since the height of such a strip is many times less than its length and it is therefore relatively narrow in comparison to its length, especially the aforementioned advantages of bracings or distortions can be prevented here by a coextruded part.

Preferably it is provided that the decorative part is arranged in a U shape on the base part. Therefore at least two bends are embodied on the decorative part.

Preferably it is provided that the decorative part is embodied with a thin wall region at the at least one bend in the decorative part. This means that at said bend the decorative part is less thick than in other places. This means the bend is once again easier to manufacture, without mechanical stresses occurring or without damage occurring to the material at the bend, such as for example cracks or the like.

Preferably it is provided that on a rear side of the decorative part facing away from a visual face of the decorative part outside a bend of the decorative part at least one attachment element is integrated, in particular that the attachment element is embodied on a side arm of a U-shaped bent decorative part. Thanks to said attachment element a thickening of the decorative part is therefore created even outside the bend, so that it is also mechanically more stable there, in order to be able to be attached to the base part. Thanks to the integration of said attachment element it is then also arranged in a permanently fixed position on the decorative part and a permanently mechanically stable attachment to the base part is thereby enabled.

It is provided that the attachment element is an L-shaped hooked rail. A simple assembly process is thereby achieved and the decorative part can be arranged permanently stably and in a fixed position on the decorative part.

However, it is additionally also possible for the decorative part to be arranged on the base part so that it can be detached non-destructively, so that it can also be reversibly removed again at any time.

Preferably it is provided that the hooked rail has a recess open at the edge on the cantilevered wall of the L shape for engagement of an engagement web of the base part. This is a particularly advantageous embodiment, since said intermeshing therefore results in a further gearing and therefore is of benefit when fixing the position of the decorative part to the base part.

Preferably it is provided that on the base part several engagement elements for coupling with the decorative part are integrated in a receiving region of the base part. This means the mechanical connection between the decorative part and the base part can be further improved at this point.

Preferably it is provided that a clamping device for clamping the decorative part is embodied on at least one end of a receiving region of the base part embodied to receive the decorative part. This means a further separate connection point is created between the decorative part and the base part, as a result of which an undesired projection of the decorative part from the base part is prevented especially thanks to the end-side coupling.

Preferably it is provided that the clamping device has at least one clamping ramp which rises toward the end and a clamping lug spaced apart therefrom, so that a clamping space is embodied between the clamping ramp and the clamping lug. Thanks to the clamping ramp a steadily rising web design is therefore provided, which permits simple and directed insertion of the decorative part, in particular of the cantilevered wall of the hooked rail. The decorative part is thereby also connected to the base part at this end-side point smoothly and therefore free from bracing and therefore causing little damage. As a result the mechanical clamping effect is furthermore gradually and continuously increased, until the final clamping state is reached.

Preferably it is provided that in the assembled state of the decorative part on the base part only the cantilevered wall of the hooked rail extends into the clamping space and is clamped therein. In the final assembled state of the decorative part on the base part the clamping lug extends in the free space between the cantilevered wall and a front part of the decorative part. Also as a result, a further mechanical mount is therefore created.

Preferably it is provided that a bracing part is embodied on a center limb of a U-shaped bent decorative part on a rear side of the decorative part opposite a visible face. As a result said center limb is especially also designed to be stable per se.

Preferably it is provided that the base part has a U-shaped bent bracket embodied in the shape of a strip as a receiving region for the decorative part.

Preferably it is provided that the household appliance component is a door rack.

In the embodiment of the decorative part as a U-shaped element an attachment element in each case extends on the side arms of the U shape and is in each case embodied in particular as an elongated, L-shaped hooked rail. The hooked rails extend in particular in each case as far as the free end of the side arms of the U shape on the rear side of the decorative part.

Preferably it is provided that a recess embodied in the cantilever wall of a hooked rail is embodied in a half of the length of the hooked rail which faces away from the free end of the U shape and is therefore closer to a bend of the side arm toward a center limb. In particular in the case of an embodiment with a clamping device said clamping device which is preferably embodied on the end side is not impaired by the recess, but thereby in particular is even beneficial for the mount.

Furthermore the invention also relates to a household appliance, in particular a household refrigeration device, which has at least one household appliance component according to the invention or an advantageous embodiment thereof. Preferably the household appliance component is a door rack on a door of the household refrigeration device.

The indications "top", "bottom", "front", "rear", "horizontal", "vertical", "depth direction", "width direction", "height direction" indicate the positions and orientations existing in the case of normal use and normal arrangement of the appliance and in the case of an observer standing in front of the appliance and looking in the direction of the appliance.

Further features of the invention will emerge from the claims, figures and description of the figures. The features and feature combinations mentioned above in the description and the features and feature combinations mentioned below in the description of the figures and/or simply shown in the figures can be used not only in the combination specified in each instance but also in other combinations or alone without departing from the scope of the invention. Embodiments of the invention that are not specifically illustrated and explained in the figures but which emerge and can be generated as a result of separate feature combinations from the described embodiments should therefore also be considered to be comprised and disclosed. Explanations and combinations of features which therefore do not have all features of an originally formulated independent claim are also to be regarded as disclosed.

Exemplary embodiments of the invention are explained in greater detail below on the basis of schematic drawings, in which.

Identical or functionally similar elements are provided with the same reference characters in the figures.

Figure 1:
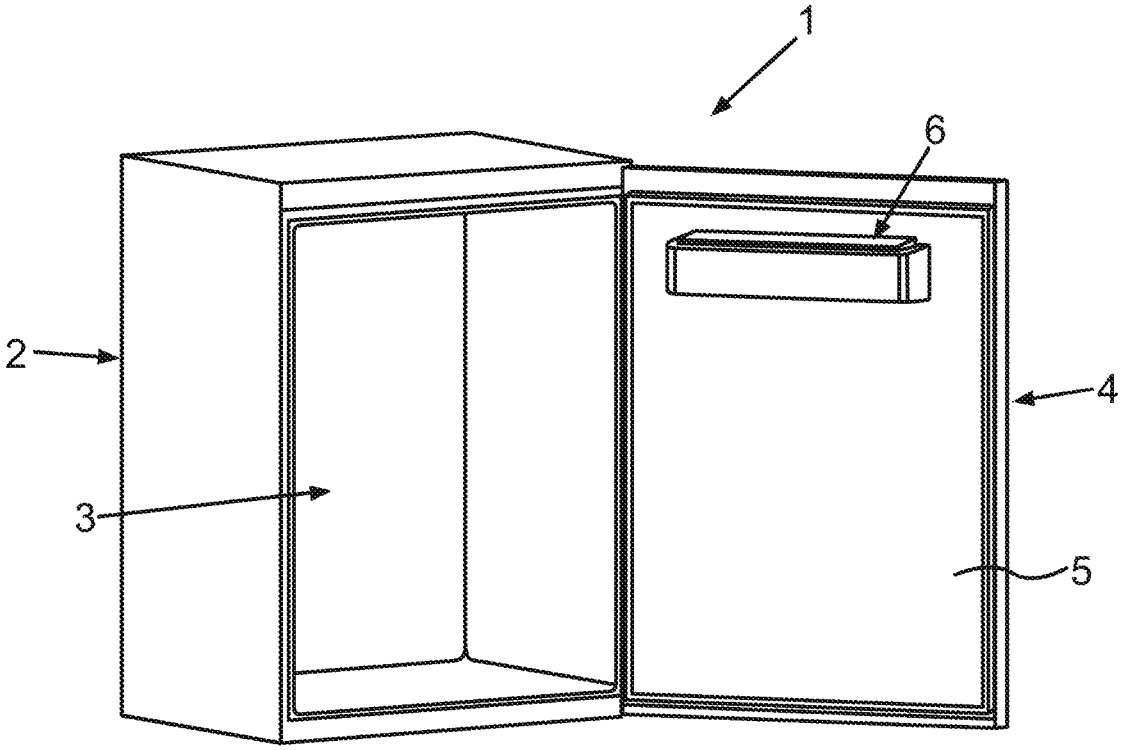
FIG. 1 shows a perspective view of an exemplary embodiment of an inventive household appliance.

FIG. 1 shows a perspective view of a household appliance 1 which can be a household refrigeration device, which can for example be a refrigerator or a freezer or a refrigerator/freezer combination appliance, and which is designed to store and conserve food. The household appliance 1 comprises a housing 2 in which is embodied a receiving space or interior space 3 for food. The interior space 3 can be closed on the front side by a door 4. Arranged on an inner side 5 of the door 4, which in the closed state of the door 4 faces the interior space 3, is at least one household appliance component in the form of a door rack 6. In the exemplary embodiment the household appliance component is therefore formed by the door rack 6.

Figure 2:
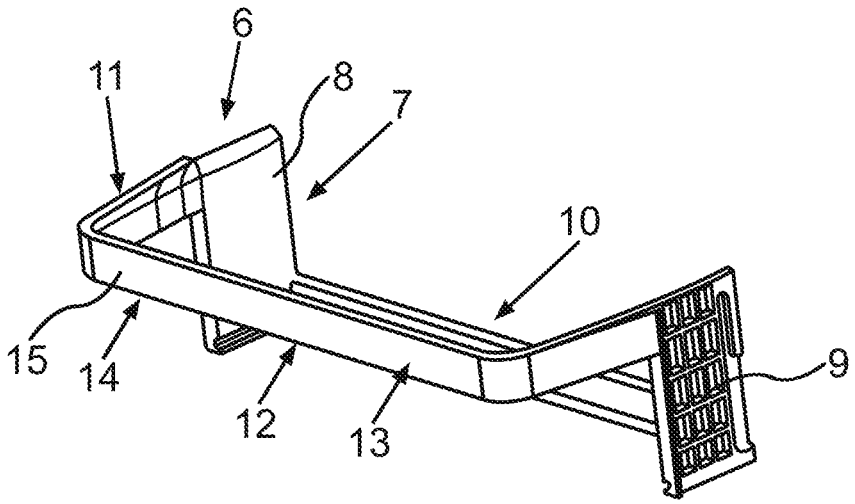
FIG. 2 shows a perspective view of an exemplary embodiment of an inventive household appliance component.

FIG. 2 shows a perspective view of an exemplary embodiment of partial components of the door rack 6. The door rack 6 comprises a base part 7 which is embodied as an integral plastic part. The base part 7 comprises two support plates 8 and 9, which are connected on a bottom rear end by a connection bridge 10. Integrally molded on the front-side narrow edges of the plates 8 and 9 is a U-shaped bracket 11 which on the front side has a receiving space 12, in particular a trough-shaped receiving space 12, for a decorative part 13 separate from the base part 7.

FIG. 2 shows the final assembled state between the base part 7 and the decorative part 13. The decorative part 13 is a coextruded part made of metal and plastic. In particular the coextruded part is embodied from aluminum and plastic.

It is provided that the metal 15 is embodied on a visible face 14 of the decorative part 13.

As is apparent, the decorative part 13 is embodied as a narrow strip which is bent in a U shape and therefore does not extend in a plane. The decorative part 13 is received in the trough-shaped receiving region 12 and is therefore also embedded at least in parts.

Figure 3:
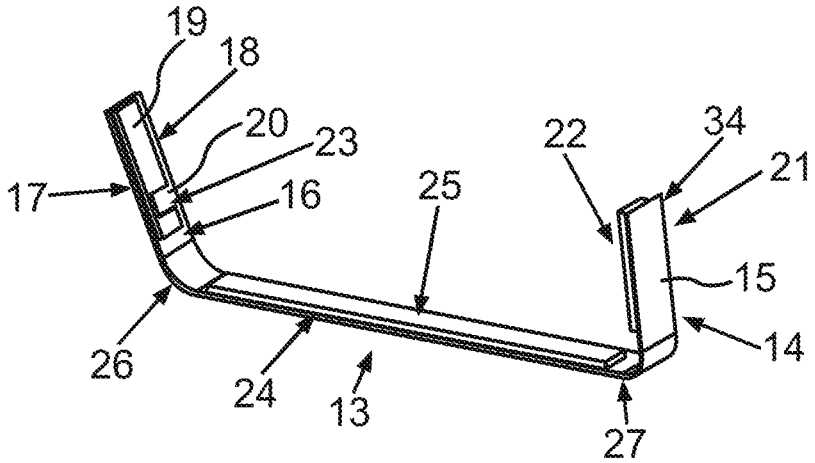
FIG. 3 shows a perspective view of an exemplary embodiment of a decorative part of the household appliance component according to FIG. 2.

FIG. 3 shows a perspective view of the decorative part 13. On a rear side 16 which is opposite the visible face 14 and is then also formed by the plastic material, a first attachment element 18 is integrated as a single piece on a side arm 17 of the U shape. Said attachment element 18 is an L-shaped hooked rail which extends with a cantilever wall 19 of the L shape parallel to and spaced apart from a front part 20 of the side arm 17.

In the case of the further side arm 21 of the U shape a corresponding further attachment element 22 is embodied, which corresponds in shape, dimensions and function to the attachment element 18.

As is additionally apparent, a recess 23 open at the edge is embodied in the attachment element 18 in this cantilever wall 19. This is embodied for the engagement of an engagement element integrally molded on the bracket 11 and embodied in the receiving region 12. As is additionally apparent, a bracing element 25 is integrally embodied in a center limb 24 of the U shape of the decorative part 13 on the rear side 16, and can for example likewise be L-shaped and therefore also additionally can be provided in an advantageous embodiment for further mechanical coupling with the receiving region 12. The bracing element 25 extends at least over 90% of the length of the center limb 24.

As is additionally apparent, the decorative part 13 is embodied to have a thinner wall at bends 26 and 27 and therefore at transitions between the side arm 17 and the center limb 24 as well as between the side arm 21 and the center limb 24. Free punching has preferably therefore been undertaken here at said bends 26 and 27. In particular said L-shaped hooked rail is then present here in the bending region 26 and 17, in particular removed by punching.

Figure 4:
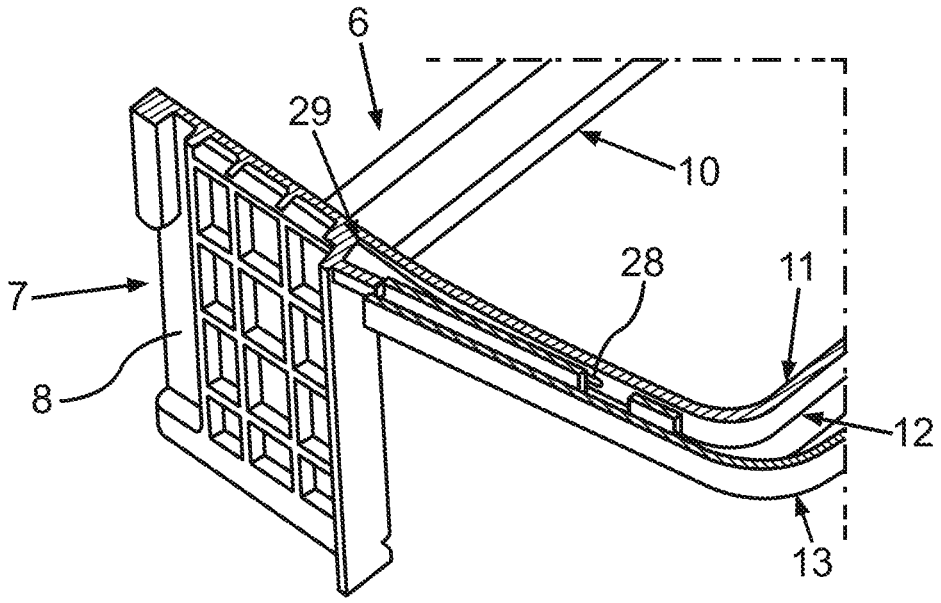
FIG. 4 shows a perspective partial view of a base part of the household appliance component and of the decorative part in an intermediate assembly state.

FIG. 4 shows a perspective horizontal section of a partial region of the door rack 6, as is shown in FIG. 2, in an intermediate assembly state. In this connection it is apparent that the decorative part 13 is still not fully pushed onto the bracket 11 in its end position.

As is apparent, a straight-line, web-like engagement element 28 is embodied in the receiving region 12. Additionally embodied on the end side of the receiving region 12 is a clamping device 29. As is apparent in more detail in the perspective view in FIG. 6, this comprises at least one clamping ramp 30 rising toward an end 12*a* of the receiving region 12, in the exemplary embodiment two clamping ramps 30 and 31 running parallel and spaced apart from one another. Spaced apart outward for this purpose, the clamping device 29 comprises a clamping lug 32, so that a clamping space 33 is embodied between the clamping lug 32 and the clamping ramps 30 and 31. The cantilever wall 29 is inserted into said clamping space 33 and achieves clamping as a function of the insertion depth in the then tapering clamping space 33. In addition the clamping lug 32 is arranged so as to extend inward in an intermediate space between the cantilever wall 19 and the front part 20.

Figure 5:
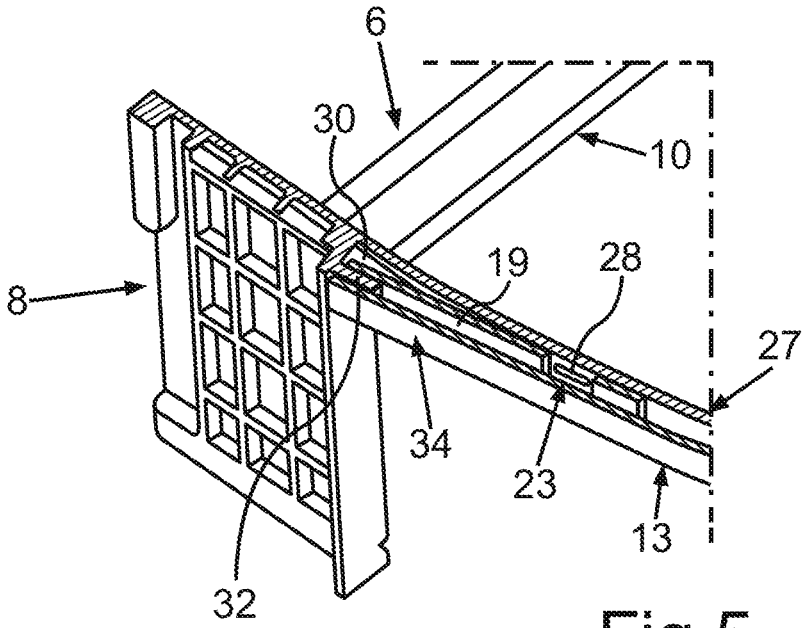
FIG. 5 shows the view according to FIG. 4 in the final assembled state of the decorative part on the base part.
Figure 6:
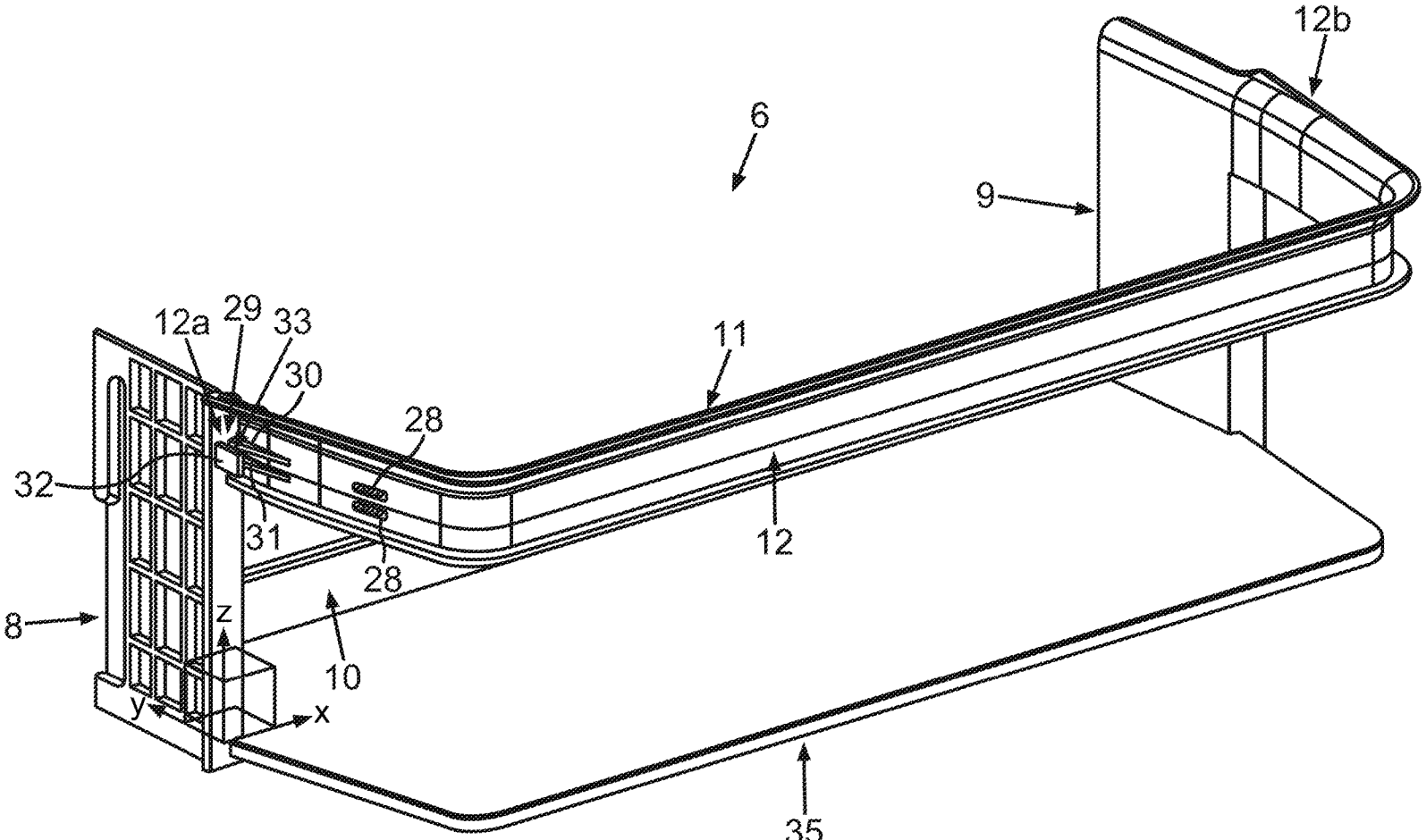
FIG. 6 shows a perspective view of an exemplary embodiment of a base part of the household appliance component.

The partial components explained in respect of the attachment element 18 are also present with identical reference characters in the case of the attachment element 22, so that in the view and explanation shown in FIG. 4, FIG. 5 and FIG. 6 the attachment element 22 and the front part (FIG. 3) of the side arm 21 correspond to the view shown in FIG. 4, FIG. 5 and FIG. 6.

If then starting from the view in FIG. 4 the decorative part 13 is pushed further in the direction of the plate 8 and therefore in the direction of the end of the receiving region 12, the engagement elements 28, two of which are shown in FIG. 6, latch in the recess 23. This is then shown in FIG. 5, in that the end position of the decorative part 13 on the base part 7 is represented.

FIG. 6 shows a perspective view of an exemplary embodiment of the base part 7 with a plate-like floor 35 arranged thereon, which is provided as a separate part from the base part 7 and is part of the door rack 6.

| List of reference characters | |
|---|---|
| 1 | Household appliance |
| 2 | Housing |
| 3 | Interior space |
| 4 | Door |
| 5 | Inner side |
| 6 | Door rack |
| 7 | Base part |
| 8 | Support plate |
| 9 | Support plate |
| 10 | Connection bridge |
| 11 | Bracket |
| 12 | Receiving space |
| 12a | End |
| 13 | Decorative part |

-continued

| List of reference characters | |
|---|---|
| 14 | Visible face |
| 15 | Metal |
| 16 | Rear side |
| 17 | Side arm |
| 18 | Fastening element |
| 19 | Wall |
| 20 | Front part |
| 21 | Side arm |
| 22 | Fastening element |
| 23 | Recess |
| 24 | Center limb |
| 25 | Bracing element |
| 26 | Bend |
| 27 | Bend |
| 28 | Engagement element |
| 29 | Clamping device |
| 30 | Clamping ramp |
| 31 | Clamping ramp |
| 32 | Clamping lug |
| 33 | Clamping space |
| 34 | Front part |
| 35 | Floor |

The invention claimed is:

1. A household appliance component having a decorative part which is arranged on a base part of the household appliance component, the decorative part being a coextruded part made of metal and plastic, the decorative part including a center limb, a first side arm, and a second side arm, a first bent region located between the center limb and the first side arm, and a second bent region located between the center limb and the second side arm, the first side arm including a first free end and the second side arm including a second free end, wherein the first bent region between the first side arm and the center limb is free from reinforcement such that both a front side and a rear side of the first bent region are unencumbered metal, wherein the second bent region between the second side arm and the center limb is free from reinforcement such that both a front side and a rear side of the second bent region are unencumbered metal, and wherein the metal extends continuously from the first free end to the second free end, and wherein plastic includes three plastic components, a first plastic component located on a rear face of the metal at the first side arm, a second plastic component located on the rear face of the metal at the second side arm, and a third plastic component located on the rear face of the metal at the center limb, the first plastic component spaced from the third plastic component by the first bent region, the second plastic component spaced from the third plastic component by the second bent region, wherein the first plastic component, the second plastic component, and the third plastic component are coextruded with the metal.

2. The household appliance component as claimed in claim 1, wherein the metal is embodied on a visible face of the decorative part.

3. The household appliance component as claimed in claim 1, wherein the decorative part is embodied as a strip.

4. The household appliance component as claimed in claim 1, wherein the decorative part is arranged in a U shape on the base part.

5. The household appliance component as claimed in claim 1, wherein the decorative part is embodied with a thin wall region at the bent region such that a thickness of the thin wall region is less than a thickness at the center limb.

6. The household appliance component as claimed in claim 1, wherein at least one attachment element is integrated on the rear side of the decorative part facing away from a visual face of the decorative part outside the first bent region of the decorative part on the first side arm of the decorative part, wherein the decorative part is U-shaped.

7. The household appliance component as claimed in claim 6, wherein the attachment element is an L-shaped hooked rail.

8. The household appliance component as claimed in claim 7, wherein the hooked rail has a recess open at an edge on a cantilevered wall of the L shape for engagement of an engagement element of the base part.

9. The household appliance component as claimed in claim 1, wherein several engagement elements for coupling with the decorative part in a receiving region of the base part are integrated on the base part.

10. The household appliance component as claimed in claim 1, wherein a clamping device for clamping the decorative part is embodied on at least one end of a receiving region of the base part embodied to receive the decorative part.

11. The household appliance component as claimed in claim 10, wherein the clamping device has at least one clamping ramp rising toward the end and a clamping lug spaced apart therefrom, so that a clamping space is embodied between the clamping ramp and the clamping lug.

12. The household appliance component as claimed in claim 8, wherein in the assembled state of the decorative part on the base part only the cantilever wall extends into the clamping space and is clamped therein.

13. The household appliance component as claimed in claim 1, wherein a bracing part is embodied on the center limb of a decorative part bent in a U-shape on a rear side opposite a visible face.

14. The household appliance component as claimed in claim 1, wherein the base part has a bracket embodied in a strip shape and bent in a U shape with a receiving region for the decorative part.

15. The household appliance component as claimed in claim 1, wherein the household appliance component is a door rack.

16. The household appliance component as claimed in claim 1, wherein the metal is aluminum.

17. The household appliance component as claimed in claim 1, wherein the metal of the decorative part is visible and exposed from the first side arm to the second side arm.

18. The household appliance component as claimed in claim 1, wherein the household appliance component is configured to be arranged in a household refrigeration device, wherein the base part includes a U-shaped receiving region having a first end and a second end, the first end connected to a first support plate and the second end connected to a second support plate, wherein the first free end is secured to the first end of the receiving region and the second free end is secured to the second end of the receiving region, wherein when the decorative part is attached to the base part an outer surface of the metal at the first free end and at the second free end remains visible and exposed.

19. The household appliance component as claimed in claim 1, wherein a cross section of the first plastic component adjacent the first free end is the same as a cross-section of the third plastic component, and a cross-section of the second plastic component adjacent the second free end is the same as the cross-section of the third plastic component.

20. The household appliance component as claimed in claim 1, wherein the base part includes a support plate with a top end, wherein the decorative part extends from the top end of the support plate along a front face of the base part and the decorative part forms a top edge of the base part.

21. The household appliance component as claimed in claim 1, further comprising a U-shaped bracket that extends from a first support plate of the base part to a second support plate of the base part, wherein the U-shaped bracket includes a trough that extends at least along a central limb of the base part, wherein at least the third plastic component is located in the trough.

* * * * *